US010000893B2

(12) United States Patent
Leo et al.

(10) Patent No.: US 10,000,893 B2
(45) Date of Patent: Jun. 19, 2018

(54) MACHINE FOR PREPARING AND LAYING A BITUMINOUS CARPET FOR CLOSING MICRO-TRENCHES

(71) Applicants: SIRTI S.P.A., Milan (IT); FALABELLA EGIDIO & C S.R.L., Latronico (PZ) (IT)

(72) Inventors: Angelo Leo, Turin (IT); Edoardo Cottino, Milan (IT); Egidio Falabella, Latronico (IT)

(73) Assignee: SIRTI S.P.A., Milan (IT)

( * ) Notice: Subject to any disclaimer, the term of this patent is extended or adjusted under 35 U.S.C. 154(b) by 0 days. days.

(21) Appl. No.: 15/453,214

(22) Filed: Mar. 8, 2017

(65) Prior Publication Data

US 2017/0260701 A1 Sep. 14, 2017

(30) Foreign Application Priority Data

Mar. 8, 2016 (IT) ..... 102016000024244

(51) Int. Cl.
*E01C 19/00* (2006.01)
*E01C 19/10* (2006.01)
(Continued)

(52) U.S. Cl.
CPC ..... *E01C 19/002* (2013.01); *E01C 19/004* (2013.01); *E01C 19/10* (2013.01);
(Continued)

(58) Field of Classification Search
CPC ..... E01C 19/002; E01C 19/004; E01C 19/10; E01C 19/18; E01C 19/22
(Continued)

(56) References Cited

U.S. PATENT DOCUMENTS 4,507,012 A 3/1985 Corcoran et al.
4,831,958 A * 5/1989 Selby ..... E01C 23/0973 118/108
(Continued)

FOREIGN PATENT DOCUMENTS

DE 3821089 A1 1/1989
FR 2750717 A1 1/1998
GB 2043752 A 10/1980

OTHER PUBLICATIONS

Italian Search Report and Written Opinion from Italian Patent Application No. UA20161455, dated Sep. 15, 2016.

*Primary Examiner* — Raymond W Addie
(74) *Attorney, Agent, or Firm* — Merchant & Gould P.C.

(57) ABSTRACT

A machine lays a bituminous carpet for closing microtrenches. The machine includes a truck having a drive system, which defines a footprint area on a surface whereon the truck can move, and a preparing device for preparing bitumen for laying. The preparing device includes a bitumen container having an inlet into which bitumen in introduced, an outlet through which the bitumen prepared for laying exits, a heating system for raising the temperature of the bitumen introduced into the preparing device. A laying device receives the bitumen prepared for laying and lays the bitumen in carpet form. The laying device includes a forming element for shaping and laying bitumen as a carpet over a laying area; a drain channel, between the outlet of the preparing device and the forming element, conducting bitumen towards the forming element. The preparing device includes a mixing device mixing the bitumen while preparing it for laying.

11 Claims, 5 Drawing Sheets

(51) Int. Cl.

| | |
|---|---|
| ***E01C 19/18*** | (2006.01) |
| ***E01C 19/22*** | (2006.01) |
| ***E01C 19/48*** | (2006.01) |
| ***E02F 5/12*** | (2006.01) |

(52) U.S. Cl.
CPC ..... *E01C 19/18* (2013.01); *E01C 19/22* (2013.01); *E01C 19/48* (2013.01); *E02F 5/12* (2013.01)

(58) Field of Classification Search
USPC ..... 404/101, 105–108, 113
See application file for complete search history.

(56) References Cited

U.S. PATENT DOCUMENTS

| | | | | |
|---|---|---|---|---|
| 6,109,826 | A * | 8/2000 | Mertes | E01C 19/45 392/472 |
| 6,439,806 | B1 * | 8/2002 | Dillingham | E01C 19/45 126/343.5 A |
| 7,641,420 | B2 * | 1/2010 | Becker | E01C 19/17 404/107 |
| 8,992,120 | B2 * | 3/2015 | Fredrickson | G06F 17/5081 404/107 |
| 2006/0104716 | A1 * | 5/2006 | Jones | E01C 23/065 404/77 |

* cited by examiner

MACHINE FOR PREPARING AND LAYING A BITUMINOUS CARPET FOR CLOSING MICRO-TRENCHES

This application claims benefit of Ser. No. 102016000024244, filed 8 Mar. 2016 in Italy and which application is incorporated herein by reference. To the extent appropriate, a claim of priority is made to the above disclosed applications.

BACKGROUND OF THE INVENTION

The present invention relates to a machine for preparing and laying a bituminous carpet, which may have particular elastic characteristics, for closing microtrenches, the latter having been excavated in the road surface for laying infrastructures such as electric or optical-fiber cables.

The machine according to the present invention can prepare the bitumen for laying, and can lay a bituminous product, which may have particular elastic characteristics, for closing microtrenches less than 30 cm wide, e.g. approx. 10 cm or 5 cm wide.

Bitumen laying machines are known which can lay a bituminous carpet wider than 50 cm for road resurfacing purposes.

Such machines can only lay a bitumen carpet along the path carried out by the machine itself, in particular on the layout traced by the machine itself.

Such machines comprise an accommodating tank for bitumen, which is normally in crushed-stone form; the bitumen is rapidly heated and moved to the laying area in order to be laid.

Bitumen melting devices are also known, which can reduce the viscosity of the bitumen in order to make it malleable and layable in carpets either manually or by means of stand-alone laying machines. Such melting devices comprise a mixing device for increasing the bitumen heating power, thus reducing the risk of excessive heating that might impair the physical characteristics of the bitumen. The bitumen heated by the melting device is normally laid manually for closing microtrenches or holes. Normally such melting devices are designed for providing a volume of bitumen ready for laying of at least 250 liters.

Such melting devices cannot prepare a mixture of bitumen and crushed stone, since they are exclusively dedicated to bitumen preparation only.

It is also known that in the realization of microtrenches, excavations are made 50 cm deep, thus interfering with most underground utilities. The same microtrench is usually 5÷10 cm wide, such width being sometimes excessive for the very small size of the miniducts that need to be laid.

Once the infrastructure has been laid, the trench is partially filled with concrete, e.g. coloured concrete, which requires a few days for consolidating. The trench is then filled level with bituminous material with low bitumen content and small stone elements, commonly referred to as "binder". This closing is only temporary, in that after a few months the surface will be milled and the final bitumen carpet will be laid. This carpet laid by paver machines is wider than the trench. Therefore, in the processes currently implemented, costly operations are needed which require work to be carried out in the excavation area at least three times, resulting in clear environmental discomfort.

The technique currently in use for making microtrenches has shown some criticalities, such as:

- uncontrolled shrinkage of the concrete used for filling, due to its intrinsic poor quality.

- wrong belief that the miniducts need to be protected by putting part of the excavation material back into the trench.

The above criticalities have the following adverse effects on the works carried out:

- local crushing of the miniducts in several places, leading to complete obstruction and preventing the laying of the optical cable, thus making it necessary to dig additional holes in order to solve the problem;
- lowering of the concrete layer due to shrinking, resulting in a broken road resurfacing carpet and infiltration of water, which can freeze and deteriorate the bituminous surface.

It is known that microtrenches for laying new infrastructures are excavated along the edge of the road in order to reduce the impact on the road surface and allow vehicles to circulate while the work for digging the microtrench, laying the infrastructure and closing the microtrench is in progress.

As regards the use of concrete, the following considerations must be taken into account:

- tensile and shearing stresses are concentrated in a region of the microtrench close to its surface (thickness of less than 0.05 m);
- by replacing the first 0.05 m with more ductile and deformable filling material, it is possible to reduce the stress concentrations, resulting in a positive effect on the overall behaviour of the system;
- a microtrench filled with concrete alone leads, due to the higher rigidity of this material compared to the road pavement, an increase in the horizontal tensile stresses in the area of contact between the pavement and the microtrench.

Therefore, the presence of a material having mechanical characteristics similar to those of the carpet and binder layers in the upper part of the microtrench, e.g. 50 mm thick, completely solves the problem caused by concrete use.

It follows that those roads which are more structured, i.e. made as required by the regulations, are less vulnerable.

As previously specified, microtrenches are currently closed with cement or concrete, or with bitumen. The use of cement or concrete provides faster trench closing, but on the other hand it leads to increased degradation of the road surface because of the different thermal expansion and strength of cement compared to bitumen. Since microtrenches are small, the use of bitumen requires manual work because, down to the present day, no machines have been available for laying small bituminous carpets which can also work near the edge of the road.

At present, no machines for preparing and laying a small bituminous carpet exist which can also work near the outer edge of the road surface in a fast and safe manner.

SUMMARY OF THE INVENTION

The present invention aims at solving the above-described technical problems by providing a machine for preparing and laying a bituminous carpet for closing microtrenches, which can prepare the bitumen for laying even if the latter has particular elastic characteristics, thus being able to lay a bitumen carpet which is small in size.

One aspect of the present invention relates to a machine for preparing and laying a bituminous carpet.

BRIEF DESCRIPTION OF THE DRAWINGS

The features and advantages of the machine will become clear and apparent from the following description of two possible exemplary embodiments thereof and from the annexed drawings, wherein:

FIG. 1A is a perspective view of the machine according to the present invention, while FIG. 1B is a schematic top view of the same machine;

FIG. 2A is a perspective view of the preparing device, while FIG. 2B is a schematic sectional view of the preparing device relative to the plane 2B-2B;

FIG. 3A is a perspective view, FIG. 3B is a schematic side view, and FIG. 3C is a schematic top view;

FIG. 4A is a side view of the machine, while FIG. 4B is a top view of the machine of FIG. 4A;

DETAILED DESCRIPTION OF THE PREFERRED EMBODIMENTS

Figure 1B:
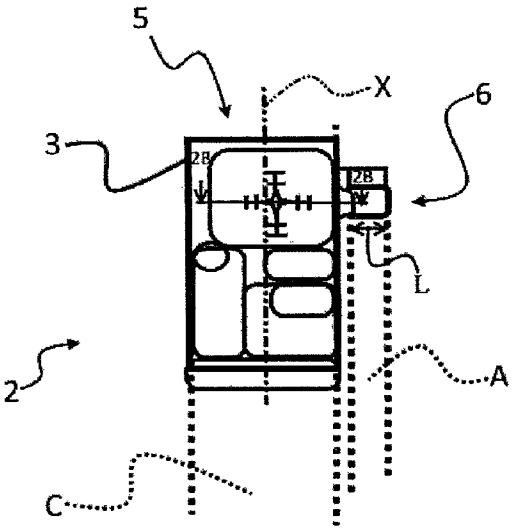
FIGS. 1A and 1B show different views of a first exemplary embodiment of the machine; in particular.

With reference to the above figures, the machine for laying a bituminous carpet, in particular suitable for closing microtrenches "T", is designated as a whole by reference numeral 2.

The machine 2 according to the present invention comprises a truck 3, in its turn comprising a drive system 31 for driving the machine 2. Said truck 3 defines a footprint area "C" on a surface, in particular on the ground, whereon the truck 3 can move.

The machine 2 according to the present invention comprises at least one preparing device 5 for preparing bitumen for laying. Said preparing device 5 comprises a container 50 for containing at least bitumen. In turn, said container 50 comprises an inlet opening 50*a* into which at least bitumen is introduced.

The preparing device 5 comprises also an outlet opening 50*b*, through which the bitumen, or a bituminous mixture, prepared for laying can exit; and a heating system 51 for raising the temperature of the bitumen, or bituminous mixture, and prepare it for laying, at least in the preparing device 5. Preferably, said heating system 51 comprises a control system for controlling the temperature in various locations of the machine, in order to maintain the proper temperature and promoting the preparation and laying of the bitumen, or bituminous mixture.

For the purposes of the present description, the term "bitumen" will hereafter refer to both bitumen as such and a bituminous mixture consisting of bitumen and other materials, e.g. inert materials. By way of example, the average density of a bituminous mixture is approx. 2,250 kg/m$^3$.

The machine 2 according to the present invention comprises at least one laying device 6 for both receiving the bitumen prepared for laying that exits through said outlet opening 50*b* and laying the bitumen in carpet form. Said laying device 6 comprises: a forming element 62 for shaping the bitumen and laying it as a carpet over a laying area "A"; and a drain channel 61, interposed between the outlet opening 50*b* of the preparing device 5 and the forming element 62. Said drain channel 61 is adapted to conduct the bitumen towards said forming element 62. In general, the bitumen or bituminous mixture enters the microtrench "T" by gravity and fills it completely.

Said forming device 6 further comprises a support structure 63 for connecting said forming element 62 to the truck 3.

Near said outlet opening 50*b*, a closing element 54 is comprised for selectively closing said outlet opening 50*b*. Said closing element 54 is, for example, a gate-type or guillotine-type device. Said closing element 54 may be operated either manually or by means of an electromechanical system.

Said preparing device 5 comprises a mixing device 52 for mixing the bitumen contained in the preparing device 5. Thus, the machine 2 according to the present invention allows bituminous mixtures to be prepared and laid into a microtrench "T" for closing the same by using a single machine.

In a first exemplary but non-limiting embodiment, said preparing device 5 has said outlet opening 50*b* formed in said container 50. Said outlet opening 50*b* is located in the bottom part of the container 50. In this embodiment of the preparing device 5, said inlet opening 50*a* is associated with a further closing element 53 for closing the same opening 50*a*, while still allowing access to the container 50 for introducing therein the bitumen or the bituminous mixture or the single parts making up the mixture, such as inert materials. Said closing element 53 is, for example, a gate, e.g. a hinged gate.

In a preferred embodiment, at least one sensor is associated with said closing element 53 for stopping the mixing device 52 when the closing element 53 is opened.

In this embodiment of the preparing device 5, the mixing device 52 is within the container 50. In this embodiment there is a single container 50, into which the components of the bituminous mixture are introduced, heated until they enter a so-called liquid state, i.e. a low-viscosity condition, and mixed together. This embodiment is comprised, for example, in the machine shown in FIG. 1A. In this embodiment, said preparing device 5 may be a melting device that includes a mixing device 52 inside it.

This embodiment allows preparing the bitumen for laying through the use of a single device, thereby reducing the machine production costs.

In a second exemplary but non-limiting embodiment, said preparing device 5 comprises, in addition to a container 50, in turn comprising an inlet opening 50*a* into which bitumen is introduced, also a mixing chamber 52*a* wherein said mixing device 52 is located.

Said container 50 is, for example, a melting device suitable for heating the bitumen by means of said heating system 51 in order to reduce the viscosity thereof, thus causing it to liquefy.

Said mixing chamber 52*a* is heated by the heating system 51.

Said mixing chamber 52*a* is in fluidic connection with the container 50. Said container 50 is adapted to heat and liquefy the bitumen, thus acting as a melting device. Bitumen heating allows feeding the mixing chamber 52*a* with bitumen that is already in the liquid state. The container 50 is connected to said mixing chamber 52*a* by a duct. The bitumen is caused to flow along said duct by pumping elements, such as, for example, a plunger pump, e.g. a manual one. Said pumping elements take in liquid bitumen from the container 50 and deliver it into the mixing chamber 52*a*.

Figure 4A:
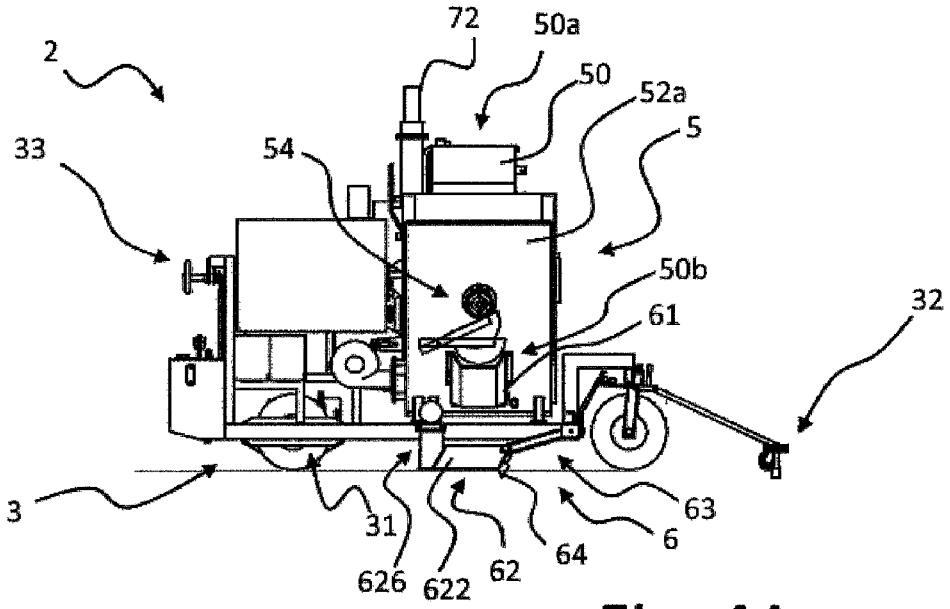
FIGS. 4A, 4B show a second embodiment of the machine; in particular.

In said mixing chamber 52*a*, the liquid bitumen is mixed with other components to form a desired bituminous mixture. FIG. 4A shows one possible implementation of the present embodiment.

Said mixing chamber 52*a* comprises said outlet opening 50*b*, through which the bitumen can exit, ready for laying. Said outlet opening 50*b* is located in the bottom part of the mixing chamber 52*a*.

In the present embodiment, said container 50 is positioned higher from the ground than the mixing chamber 52*a*.

In this embodiment of the preparing device 5, a first closing element 53 is associated with said inlet opening 50*a* for closing the same opening 50*a*, while still allowing access to the container 50 for bitumen introduction. Said first closing element 53 is, for example, a gate, e.g. a hinged gate.

In general, at storage or ambient temperature the bitumen is in the form of a parallelepipedon or block having average dimensions of 500×400×200 mm in a solid or high-viscosity state.

In this embodiment of the preparing device 5, said mixing chamber 52*a* comprises an additional inlet opening with which a second closing element 53*a* is associated for closing the same opening, while still allowing access to the mixing chamber 52*a* for the introduction of inert material to be used for creating the desired bituminous mixture. Said closing element 53*a* is, for example, a gate, e.g. a hinged gate.

In the present embodiment, said container 50 has a smaller volume than the mixing chamber 52*a*, because the low-viscosity part of the bituminous mixture, which mostly consists of bitumen, represents only 5-25% in weight of the mixture, whereas the remaining percentage consists of inert material having a lower specific weight than bitumen. Therefore, the volume of the mixing chamber 52*a* needs to be greater than that of the container 50 acting as a melting device.

In the present embodiment, the production of bitumen in the liquid state can continue separately from the production of bituminous mixture, and it is possible to only add the desired amount of bitumen to the mixture, while having a stock of bitumen readily available for the next preparation of bituminous mixture.

Figure 1A:
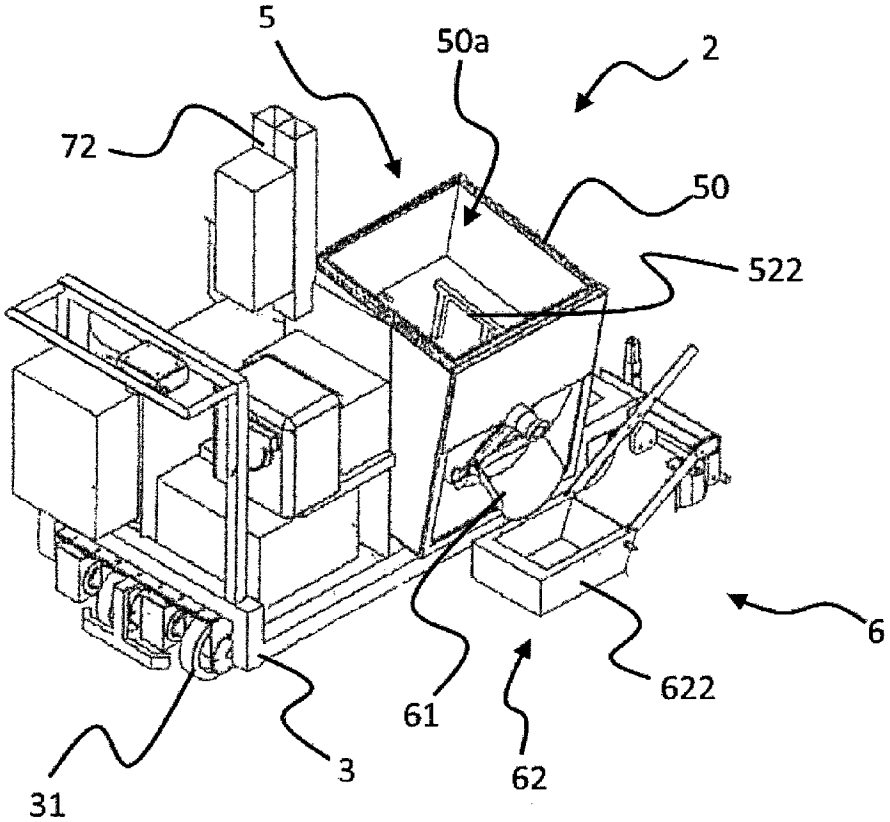
Figure 4B:
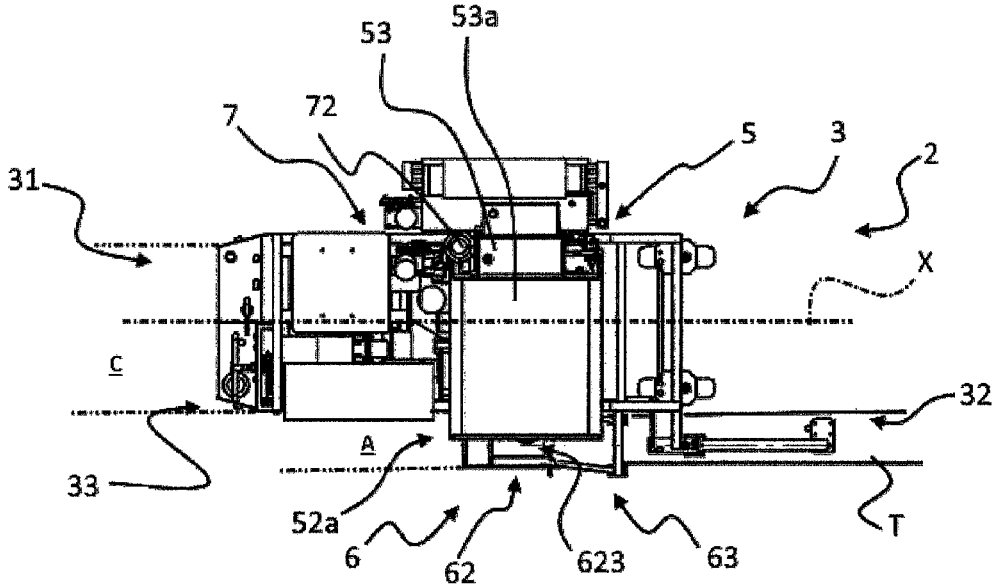

In the preferred embodiment, said preparing device 5 is secured to said truck 3. In particular, said preparing device 5 is so arranged as to remain substantially within the outline of the truck 3, at least for most of its volume. This solution provides a single bitumen laying machine that can be easily moved. FIG. 1A shows an embodiment wherein the preparing device 5 is completely within the outline of the truck 3; FIG. 4B shows how, in this embodiment, a part of the preparing device 5 protrudes from the outline of the truck 3.

In the preferred embodiment, said laying device 6 is secured to said truck 3 and protrudes from the outline of the truck 3. Said support structure 63 is so shaped as to connect said forming element 62 to the truck 3, while allowing the forming element 62 to protrude from the outline of the truck 3. The present solution makes the machine 2 easily adaptable to different conditions, while still ensuring high manoeuvrability by the user.

More in detail, said laying device 6 is arranged laterally relative to the truck 3. In the preferred embodiment, said forming element 62 is arranged laterally relative to the truck 3 through the use of a support structure 63. The forming element 62 can lay bitumen over a laying area "A" defined by the motion of the truck 3.

In general, said laying area "A" is thus substantially parallel to, and in particular not coincident with, the footprint area "C" of the truck 3. Said footprint area "C" is aligned with an axis of symmetry "X" of the truck 3.

The machine 2 according to the present invention is so shaped that said laying area "A" has a transversal width "L" comprised between 0.2 and 0.01 meters. Therefore, the forming element 62 is so shaped as to deposit a bituminous carpet having a transversal width "L" of the laying area "A" comprised between 0.1 and 0.03 meters. In a preferred embodiment, said forming element 62 has a transversal width "L" comprised between 0.1 and 0.03 meters, more preferably between 0.05 and 0.03 meters.

In general, in one possible embodiment of the machine 2, said heating system 51 for increasing the temperature of the bitumen, e.g. the one inserted in the container 50, is a diathermic-oil system. Said heating system 51 is a forced-circulation diathermic-oil system comprising, for example, an oil supply and containment tank, a circuit of ducts and coils wherein the oil can circulate to provide heating of the materials that make up the mixture, by heating the elements which contain them or through which they flow; and a pump, e.g. an electric pump, for oil circulation, and an expansion tank. The technical features of the heating system are not illustrated in detail, but they are applicable to both of the embodiments of the machine 2 described herein.

Said heating system 51 comprises an electronic temperature control circuit, which can appropriately adjust the temperature of the heating system 51 to ensure progressive heating of the bitumen, thus preventing the bitumen from burning and/or the bituminous mixture from losing its elastic and/or plastic characteristics for which it was generated.

In one possible exemplary embodiment of the heating system 51, the diathermic oil is heated by hot fumes produced by a burner, e.g. a diesel burner.

In general, said laying device 6 and/or said mixing device comprise heating elements for contributing to at least keeping the bitumen hot.

In particular, said mixing device 52 may comprise heating elements suitable to provide a better and more uniform heat distribution in the bitumen. This feature allows speeding up the heating of the bitumen and/or keeping it at the ideal temperature, thus reducing its viscosity and making it easier to lay, while avoiding that it might cool down and increase its viscosity.

In one possible embodiment of the laying device 6, said drain channel 61 has a concave shape suitable for avoiding leaks of bitumen from said channel before it reaches the forming element 62.

One possible embodiment of said laying device 6 comprises heating elements positioned on the drain channel 61 and/or on the forming element 62.

In the embodiment wherein the drain channel 61 comprises heating elements, it is ensured that the bitumen exiting through the outlet opening 50*b* of the preparing device 5 cannot cool down before arriving at the forming element 62, thus avoiding that the bitumen might increase its viscosity and make laying the bituminous carpet by means of said laying device 6 more difficult.

In the embodiment wherein the forming element 62 comprises heating elements, it is ensured that the bitumen can be laid to create a bituminous carpet at the most appropriate temperature, so that the best characteristics of bitumen can be fully exploited.

In a preferred embodiment, said heating elements are ducts or chambers in which diathermic oil can flow, e.g. connected to the heating system 51.

In one possible embodiment, said forming element 62 comprises a hollow structure connected to said heating system 51, so that diathermic oil can flow therethrough to keep the bituminous mixture hot.

In an alternative embodiment, said heating elements may be electric circuits suitable for causing electric current to flow on a surface and dissipate a known amount of power as heat, resulting in said surface being heated up.

In the preferred embodiment of the machine 2, said drain channel 61 comprises heating elements for heating it. Furthermore, in the preferred embodiment, also said forming element 62 is heated by means of heating elements.

More in detail, said preparing device 5, and in particular said mixing device 52 and said mixing chamber 52*a* and/or container 50, are so shaped that mixtures comprising bitumen and inert material, e.g. crushed stone and/or sand, can be blended together. In this manner, bituminous mixtures of different kinds can be obtained, depending on specific requirements to be met when closing the microtrench "T".

In particular, said mixing device 52 comprises at least one blade 522 capable of turning about an axis of rotation "k". Stirring the bitumen in the container 50 and/or in the mixing chamber 52*a* ensures, among other things, proper distribution of the heat in the bitumen and/or of the inert material inside the container 50 of the preparing device 5.

Said at least one blade 522 may comprise protuberances or palettes or vanes appropriately shaped to exert the utmost mixing effect on the bitumen.

In one possible embodiment, said mixing device 52 comprises an actuator device adapted to allow the rotation of said at least one blade 522.

In one possible embodiment, the mixing device 52 comprises an adjuster device 523 capable of changing the revolution speed of said at least one blade 522 over time, in order to provide proper mixing as a function of several parameters, such as, for example, bitumen viscosity, type of bituminous mixture, operating phase of the machine. Said adjuster device may be a mechanical one, e.g. a gear system interposed between the actuator device and the blade 522, or an electronic device adapted to control the actuator device by varying the revolution speed and/or power thereof.

In one possible embodiment of said mixing device 52, said at least one blade 522 comprises, in turn, heating elements.

The actuator device for driving said blade 522 has a power of, for example, less than 1 kW, e.g. 0.8 kW.

In one exemplary but non-limiting embodiment of the machine 2, the latter comprises a preparing device 5 having a container 50, and/or a mixing chamber 52*a*, having a capacity not exceeding 400 l, preferably a usable capacity of approx. 130 l.

Such a volumetric capacity of the container 50 and/or of the mixing chamber 52*a* corresponds to a usable capacity of less than 350 kg, preferably approx. 280 kg.

In the preferred embodiment, said at least one forming element 62 and said drain channel 61 are so shaped as to allow laying mixtures comprising bitumen and inert material, e.g. in the form of crushed stone.

In general, the machine 2 comprises at least one centering device (32, 64) fixed to the machine 2. Said centering device (32, 64) is adapted to be inserted into the microtrench "T" for the purpose of centering the forming element 62 relative to the microtrench.

Said centering device (32, 64) is adapted to move the truck and/or the forming element 62 in order to ensure that the forming element 62 will be properly centered relative to the microtrench while laying the bitumen.

In general, said forming element 62 must be laid on the ground where the microtrench "T" has been created, on top of the pit that needs to be filled.

In one possible, exemplary embodiment, the forming element 62 comprises a first centering device 64. Said first centering device 64 is adapted to keep said forming element 62 in the correct position and exactly at the center of the microtrench "T". Said first centering device 64 is, for example, a protuberance or pin to be inserted into the microtrench "T" and guide the trajectory of the forming element 62 during the filling process. In fact, said forming element 62 is moved relative to an axis perpendicular to the longitudinal extension of the microtrench "T", for the purpose of constantly aligning said forming element 62 with the microtrench "T". This movement of the forming element 62 can be implemented by properly designing said support structure 63.

In the preferred embodiment, said forming element 62 comprises a compartment 622 for collecting the bitumen coming from the drain channel 61, an outlet opening 623 through which the bitumen is laid into the microtrench "T".

Said forming element preferably comprises a levelling element 624 for levelling the bitumen laid into the microtrench "T", in particular if an excessive quantity of bitumen has come out.

In one possible embodiment of the compartment 622, the latter has a rectangular, e.g. square, section. Said compartment 622 has at least one side the length of which is substantially equal to or longer than the width of the microtrench "T" to be closed. The transversal width "L" of the compartment 622 is therefore equal to or greater than the width of the microtrench "T" to be closed.

In one possible embodiment, said compartment 622 can be removed from the machine 2 and replaced with another compartment having different dimensions. In this way it is possible to use the most appropriate compartment depending on the microtrench that needs to be closed. In particular, said compartment 622 is removably secured to the support structure 63 of the laying device 6.

In general, in one possible embodiment of the forming device said forming element 62 comprises a system for pressing the bitumen after it has been laid. Said bitumen pressing system allows consolidating the bituminous carpet laid in the microtrench. Said pressing system can be comprised in said levelling element 624.

In one possible embodiment, said pressing system can be realized as a pressure roller and/or a pressure plate, suitable for exerting a force along the vertical axis on the bituminous carpet just laid, for the purpose of compacting it. Preferably, said pressing system is comprised in the levelling element 624.

In one possible embodiment of the forming device 6, said forming element 62 comprises a vibrating system 626, applied to the compartment 622, for facilitating the laying of the bitumen by promoting the exit of the bitumen through the outlet opening 623.

The vibration applied to the forming element 62 ensures better compaction of the bituminous carpet.

In one possible embodiment, the vibrating system can be implemented as an actuator device suitable for generating motion applied to the compartment 622 along at least one axis. In some possible embodiments, said vibrating system may be able to generate sussultatory and/or rotary movements or a combination of linear, sussultatory and rotary movements applied to the compartment 622.

In a preferred but non-limiting embodiment, said forming element 62 comprises a vibrating system 626 and/or a pressing system.

The embodiment wherein the forming element 62 comprises a vibrating system 626 and a pressing system ensures, due to the pressure and vibration applied to the forming element 62, better compaction of the bituminous carpet.

One preferred embodiment of the forming element 62 is comprising a vibrating system 626 located right on top of the forming element 62 for the purpose of, during the bitumen laying phase, letting air bubbles escape, facilitating the complete filling of the microtrench, and ensuring adequate compaction of the bituminous carpet.

Said vibrating system 626 comprises an adjuster device, which can preferably be controlled remotely, for adjusting the vibration frequency. The adjustment of the vibration frequency allows adapting the vibration frequency to specific requirements, e.g. in accordance with the characteristics of the bituminous mixture.

In general, said laying device 6, and in particular said support structure 63, comprises a shifting system capable of moving said laying device 6, and in particular the forming element 62, relative to the truck 3.

In the embodiment comprising said first centering device 64, said support structure can move said forming element 62 in a manner such that the forming element will be always perfectly aligned over the microtrench "T" to be filled. In one possible embodiment, said shifting system can be used for bringing the laying device 6 closer to and/or farther from the truck 3, e.g. relative to an axis perpendicular to the longitudinal axis and/or to the axis of symmetry "X". In an alternative embodiment, said shifting system can lift said laying device 6 relative to the ground whereon the machine 2 stands, e.g. by moving said support structure 63. Such movement can occur along a vertical axis and/or as a rotation about an axis perpendicular to the axis "X". This movement of the laying device 6 can be combined with or alternative to the movement of the laying device 6 towards and/or away from the truck 3.

The shifting of the laying device 6 consists, therefore, of a movement of the forming element 62, and in particular of the compartment 622, as well as of the drain channel 61 that must follow the movements of the forming element 62, e.g. by extending or retracting and/or by moving up or down.

In general, the heating system 51 comprises, in one possible embodiment, a burner which is fed with fuel, e.g. diesel.

Preferably, the machine 2 comprises a tank for containing fuel for the burner. Said burner and said tank are arranged on the truck 3, preferably without protruding from the outline thereof.

The machine according to the present invention further comprises a fumes control system 7 that can convey at least a part of the gas generated by the propulsion system and/or by the preparing device 5 for the purpose of avoiding the emission of harmful substances into the environment. In a preferred embodiment, said first closing element 53, in those embodiments wherein it is included in the closing element 53*a* of the mixing chamber 52*a* of the preparing device 5, comprises a system of ducts adapted to convey the fumes generated by the preparing device 5 towards the fumes control system 7.

Said fumes control system 7 comprises a system of filters suitable for filtering the gas generated by the machine 2 before it is discharged into the environment.

Moreover, said control system 7 comprises an exhaust chimney through which the fumes exiting said control system 7 can come out. The size of said chimney 72 and its height from the ground are such as to prevent inhalation of fumes by the operator and/or to avoid obstructing the view of the operators using the machine 2.

In the preferred embodiment, said heating system 51 comprises a closed combustion chamber and the fumes are conveyed into the fumes control system 7.

In one possible embodiment, the drive system 31 is a wheel-type system.

In alternative embodiments (not shown), said drive system 31 is a track-type system or a skid-type system or a hybrid system.

The drive system 31 is preferably a wheel-type drive system. In the embodiment of the wheel-type drive system 31, at least one pair of wheels, e.g. the front wheels, with reference to the normal running direction of the machine 2, are steering wheels that comprise a steering system for controlling the mobility of the truck 3.

More preferably, the rear wheels of the truck 3 are drive wheels. The use of rear drive wheels and front steering wheels, in the light of the position of the preparing device 5 and of the other devices of the machine 2 on the truck 3, provides optimal control over the movements of the machine 2.

In general, said drive system 31 comprises a propulsion system that allows putting the machine 2 in motion.

Said propulsion system may be of electric or internal combustion type, e.g. an engine preferably a Diesel engine, for driving two hydraulic motors.

In general, the power of said propulsion system may be in the range of 5-10 kW.

In one exemplary embodiment, said drive system 31 comprises a speed control system, e.g. comprising an accelerator. Said speed control system allows controlling the speed of the machine 2 from 0 km/h, when the machine 2 is substantially stationary, up to a top speed of 5 km/h.

In one exemplary embodiment of the machine 2, the speed control system comprises two transmission gears for forward motion and one transmission gear for reverse motion. By way of example, a first gear for forward motion can be used when the machine is working, in particular while filling the microtrench "T", whereas a second gear can be used for transfer purposes, e.g. for reaching the microtrench "T" from the location where the machine 2 is at.

In one possible embodiment of the machine 2, the drive system 31 comprises a braking system, e.g. a drum-type and/or disk-type braking system or an engine brake and/or an electronic control system for an electric motor. In one possible embodiment, the machine comprises two gearmotors with irreversible motion, suitable to ensure braking when the machine 2 is moving or stationary.

In one possible embodiment of the machine 2, the drive system 31 comprises a locking device for locking the machine 2, which can prevent the truck 3 from moving and also the laying of bitumen. In such a configuration, the machine 2 is fully safeguarded against the risk of accidents, e.g. caused by human operators.

Preferably, the machine 2 according to the present invention comprises a second centering device 32. In one possible embodiment, said second centering device 32 comprises a mobile arm connected to the drive system 31, and in particular to the steering system 33, e.g. acting upon the steering wheels of the drive system 31.

In general, said second centering device 32 is arranged in the front of the machine 2, with reference to the direction of forward travel of the machine 2. The second centering device 32 is used when the machine 2 is filling the microtrench. During the operating phase of filling the microtrench, the end of the mobile arm of the second centering device 32 engages into the microtrench "T" to be filled, by means of a suitable rolling system, e.g. a roller-type system. This solution allows the machine 2 to exactly follow the layout of the excavated microtrench "T". Therefore, the second centering device fixed to the machine 2 is adapted to be inserted into the microtrench "T" and thus move the truck 3 and hence the forming element 62 secured to the truck 3, for the purpose of allowing the forming element 62, and in particular the compartment 622, to be properly centered relative to the microtrench while laying the bitumen.

In a preferred embodiment, said centering device 32 is an arm that, in addition to being mobile in a plane parallel to the ground in a working configuration, in order to follow the layout of the microtrench "T" by acting upon the drive system 31, can be raised and take an idle configuration. In said idle configuration, the centering device 32 is stored on the machine 2, e.g. within the outline of the truck 3, for the purpose of preventing shocks that might damage said centering device 32 and also, whether directly or indirectly, the drive system 31 or the steering system 33.

In a preferred embodiment of the machine 2, said second centering device 32 is directly connected to the steering system 33. In this embodiment, once said centering device 32 has been inserted into the microtrench "T", the machine 2 can be moved automatically by the drive system 31 along the path described by the microtrench "T", without a person having to continuously steer the machine 2 by means of the steering system 33. In this embodiment, said second centering device 32, since it is connected to the steering system 33, acts directly upon the steering wheel to define the direction of travel of the machine. In the present embodiment, a variation in the position of the second centering device 32, e.g. of the mobile arm, causes a rotation of the steering wheel. This feature allows the machine 2 to follow the layout of the microtrench "T", by means of said second centering device 32, in an automatic and autonomous manner. This embodiment allows, therefore, the machine 2 to move automatically along the path defined by the microtrench.

The machine 2 according to the present invention may comprise a safety control system for monitoring all the activities carried out by the machine 2. Said safety control system is implemented through an electric control panel installed on the truck 3 of the machine 2, preferably in such a position as to be readily accessible to the operator. Said safety control system is adapted to control a plurality of taps, preferably from a remote position, for rapidly and safely closing, in the event of a leakage, the pipes or ducts of the heating system 51 that transport the diathermic oil. The electric power necessary for the operation of the above-mentioned electronic/electromechanical devices comprised in the machine 2 is supplied by an accumulator device, e.g. a 24V battery, charged by an alternator driven, for example, by the Diesel engine of the machine.

The machine according to the present invention is intended for closing microtrenches "T" by laying a bitumen carpet or a bituminous mixture.

FIG. 1A shows a perspective view of a first exemplary embodiment of the machine 2 according to the present invention. In this image it is possible to see the compactness of the machine 2, as well as its specific configuration intended for closing microtrenches "T". FIG. 1B, which schematically shows a top view of the machine 2, allows appreciating the small dimensions of the machine and the fact that the laying area "A" is considerably smaller than the footprint area of the machine. In this image it is also possible to see that, in one possible embodiment, the laying area "A" is parallel to the footprint area of the truck 3, thus allowing for external laying, e.g. along a road, while keeping the machine on the road surface in safe area.

Figure 2B:
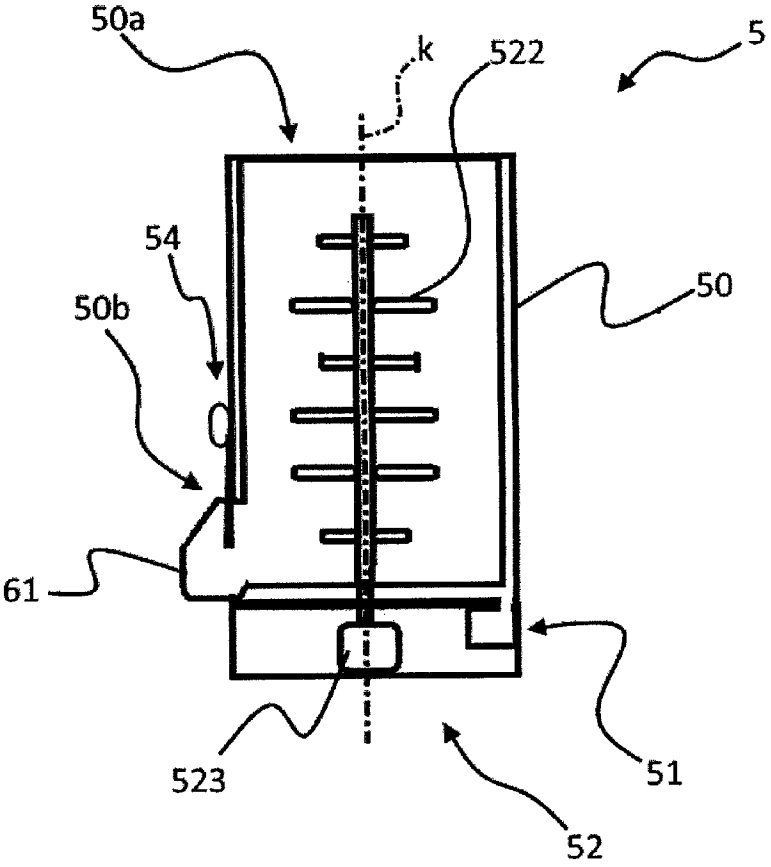
FIGS. 2A, 2B show different views of the preparing device comprised in the machine of FIG. 1A; in particular.
Figure 2A:
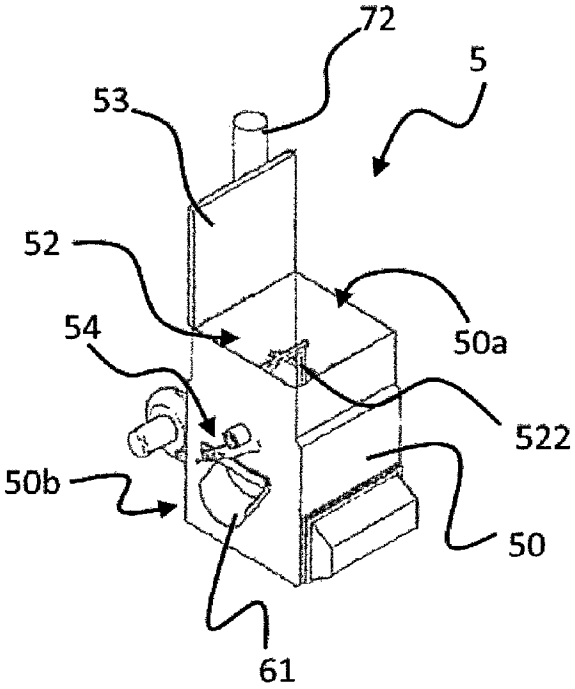

FIG. 2A shows a first embodiment of the preparing device 5. From this image it is possible to appreciate the compactness of said device, which is small and particularly suited to closing microtrenches "T". In such an embodiment, the container includes the mixing device for mixing bitumen with inert material, both components being introduced through the same opening 50*a* of the container 50.

FIG. 2B, which shows a sectional view of the container 50, allows appreciating the simplicity of use thereof, since the inlet opening 50*a* is in the top part of the container 50, thus facilitating the introduction of bitumen and/or inert material for creating the desired bituminous mixture. In addition to mixing the components of the bituminous mixture as soon as they have been introduced into the container 50, the mixing device 52 also ensures optimum heat distribution in the bitumen. FIG. 2B provides technical information useful for creating a mixing chamber 52*a*, which is adapted to receive bitumen from a container 50 positioned higher than the mixing chamber 52*a*. In the same mixing chamber 52*a*, inert material can also be introduced through an opening provided in the top part and closable by means of a closing element 53*a*, to be then mixed with bitumen by said mixing device 52.

Figure 3C:
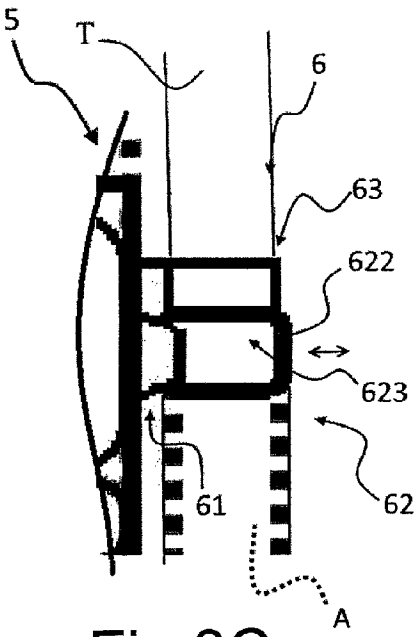
FIGS. 3A, 3B and 3C show different views of the laying device; in particular.
Figure 3B:
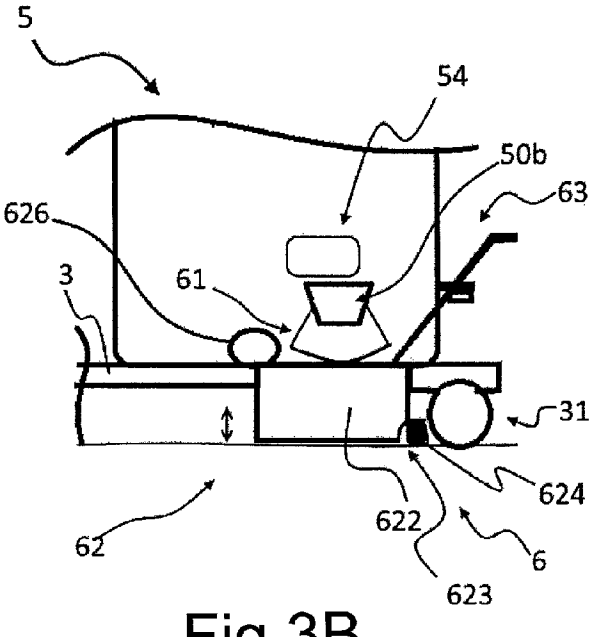
Figure 3A:
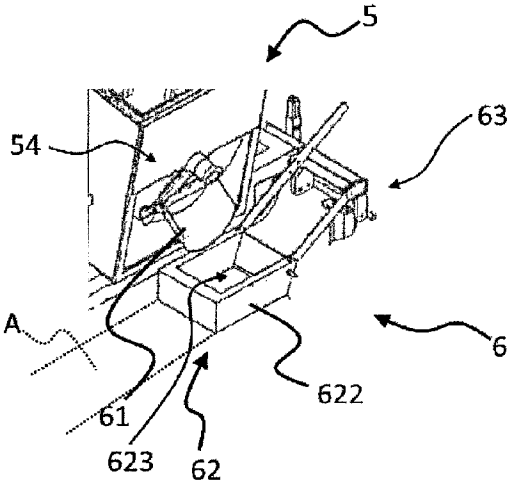

FIG. 3A shows one possible embodiment of the laying device 6, and clearly shows the drain channel 61, the forming element and the support structure 63. The concepts that can be inferred from FIG. 3A are applicable to any embodiment of the machine 2 according to the present invention.

FIG. 3B, which shows a schematic side view of the laying device 6, allows appreciating one possible embodiment of the forming element 62, and particularly the conformation of the compartment 622, outlet opening 623 and levelling element 624.

FIG. 3C, which is a schematic top view, allows appreciating the position of the laying device 6 relative to the microtrench "T" and to the bituminous carpet with which the microtrench "T" is filled.

FIG. 4A shows a side view of a second embodiment of the machine 2, wherein you can see both the first centering device 64, located near the forming element 62, and the second centering device 32, secured to the truck 3 in a front portion thereof.

In this figure it is also possible to identify the vibrating system 626.

Many technical components of the machine are visible in the illustrated embodiment which, though not described in detail herein, can be easily discerned by a man skilled in the art and are easily applicable to other embodiments of the present machine 2. In this embodiment, it is possible to appreciate the steering system 33 of the machine, including the steering wheel and the front steering wheels. In this image you can appreciate the spatial positioning of the container 50 and of the mixing chamber, as well as the different physical dimensions thereof.

FIG. 4B shows a top view of a second embodiment of the machine 2, wherein you can see the substantial symmetry of the machine with respect to the axis "X". From the same image you can also guess the operation of the centering devices of the machine according to the present invention, and how they can act upon the truck and/or the forming element in order to center the forming element relative to the microtrench "T".

Figure 5:
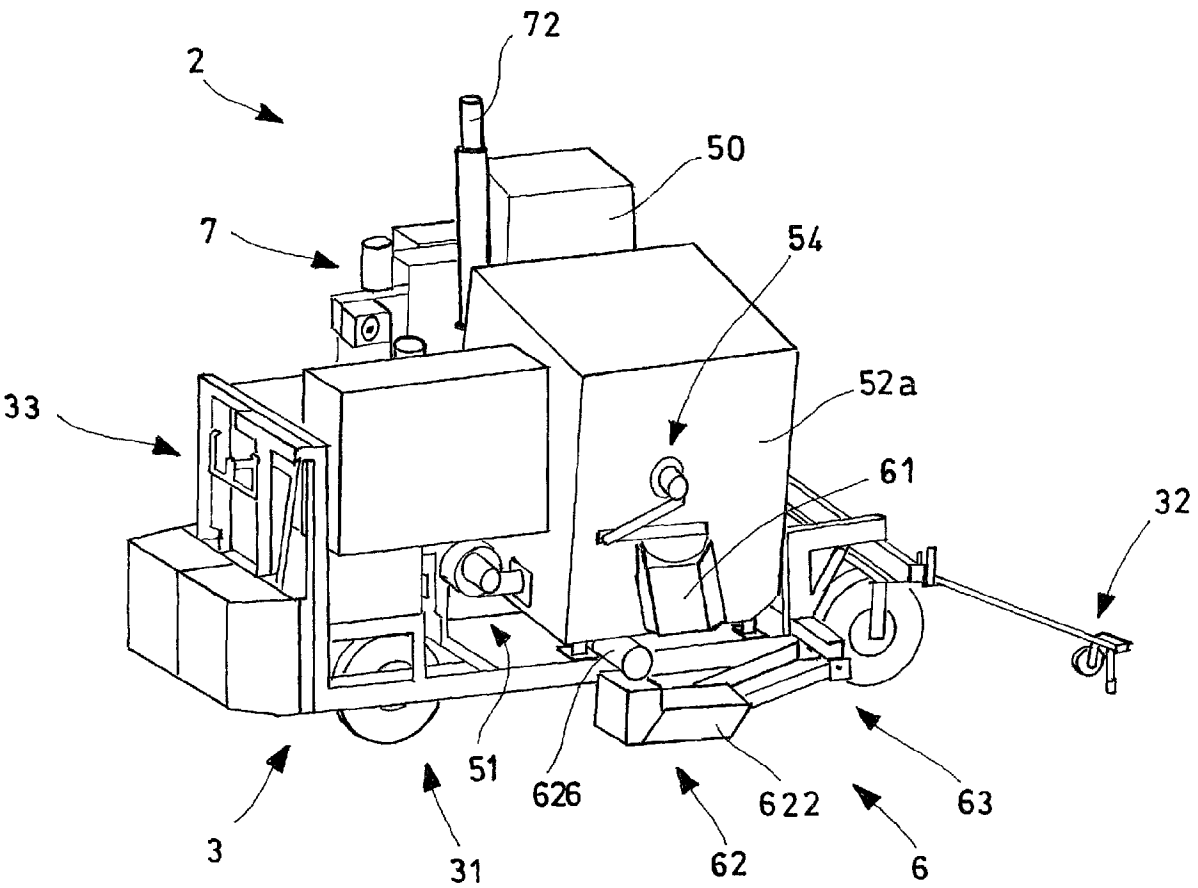
FIG. 5 is an axonometric view of the machine of FIGS. 4A and 4B.

FIG. 5 is an axonometric view of the machine 2 according to the present invention, in an embodiment thereof also illustrated in FIGS. 4A and 4B.

In this figure it is possible to see that the mixing chamber 52*a* is inclined relative to the surface defined by the truck 3, whereon the components of the machine 2 according to the present invention lie. This arrangement of the mixing chamber 52*a* promotes the exit of the bitumen contained in the same chamber towards the outlet opening 50*b*. Such a configuration also prevents the formation of areas in which bitumen can accumulate, since such accumulation areas might prevent the bitumen from exiting through the outlet opening 50*b*.

From the same image you can appreciate one possible embodiment of the linkages that allow the second centering device 32 to act upon the drive system 31, in particular upon the steering system 33, more in particular upon the front steering wheels of the truck 3.

As previously specified, said centering device 32 allows the machine 2 of the present invention to automatically follow the microtrench "T", so that the whole machine 2 can move along the path of the microtrench while ensuring that the forming element 62 is always centered on the microtrench "T". In general, this feature is particularly advantageous when the microtrench "T" is not perfectly straight, but shows trajectory changes due to several reasons, such as, for example, an obstacle that needs to be avoided or a simple human error.

One possible method of operation of the machine 2 according to the present invention comprises the following phases:

- turning on the machine 2, in particular the heating system 51;
- introducing bitumen in block form and/or already in a low-viscosity state and/or a bituminous mixture into the container 50 of the preparing device 5;
- activating the mixing device 52 in order to mix the bitumen and/or the bituminous mixture and possibly introduce an additive, such as an inert material;
- when an optimum laying temperature is reached, activating the drive system 31 of the truck 3 for the purpose of bringing the machine 2 near the microtrench "T";
- setting up the machine 2 by positioning the centering devices (32, 64) inside the microtrench "T";
- starting the laying of the bituminous carpet into the microtrench "T" in order to close the microtrench "T";
- continuing the laying until the microtrench "T" is completely closed or the bituminous mortar becomes exhausted.

The present method can be carried out with any one of the above-described embodiments of the machine 2 according to the present invention.

The phases of starting the laying and continuing the laying to completion can be carried out automatically by exploiting the second centering device 32, which allows the machine 2 to be automatically guided along the layout of the microtrench "T".

The machine 2 according to the present invention is therefore particularly suited for closing microtrenches "T". Said microtrenches "T" are dug to a depth of 0.3 to 0.6 m, e.g. 0.4 m, to avoid most underground utilities that may be already present. The slit of said microtrenches is normally 0.03 m to 0.05 m wide.

Said microtrenches are particularly suitable for housing miniducts and/or fenders.

Normally said microtrenches "T" are filled with mortar, preferably a single-component one, having a very low degree of shrinkage. The microtrench is filled with such mortar up to 0.05 m from the ground surface, e.g. a road and/or a pavement.

The machine according to the present invention thus allows filling the last 0.05 m of the microtrench with bitumen.

Preferably, said bitumen is modified bitumen, in particular comprising certified additives, e.g. certified inert material. This closing process allows applying a plug onto the microtrench. Said plug has, therefore, elastic properties.

The machine 2 according to the present invention allows closing the microtrench "T" in one day.

The closure generated by the present machine is a definitive closure that will require no further work on the ground for definitively closing it.

The use of said laid mortar and/or bituminous carpet ensures complete protection of the infrastructures laid in the microtrench, particularly of the optical infrastructure, preventing it from undergoing crushing and/or damage.

Furthermore, the used bituminous mixture acts as a glue to perfectly bind with both the asphalt and the mortar. The bituminous mixture laid by the machine 2 of the present invention optimally compensates for the thermal expansion of the asphalt, thus eliminating the cracks that typically form between old and new asphalt.

The machine according to the present invention allows laying bituminous mixtures having particular plastic and elastic characteristics, which cannot be laid by using traditional tools for manual laying, such as, for example, trowels and/or shovels and/or spreaders.

The machine according to the present invention allows making repairs, rapidly and autonomously, for small damages in the asphalt, e.g. road asphalt.

The machine 2 according to the present invention can correctly lay bituminous mixtures that are extremely adhesive and elastic, due to the fact that it uses at least one heating system capable of heating every part of the machine that comes in contact with the bituminous mixture.

The machine 2 according to the present invention has compact outer dimensions, thus minimizing the space occupied on the road surface while laying bitumen.

The machine 2 according to the present invention comprises a heating system that avoids the presence of open flames, thereby making the machine safer and reducing the number of fire-fighting devices required in the working area.

The machine according to the present invention allows reusing the material left over at the end of the laying of the bituminous carpet, thus avoiding wastage and problems related to the disposal of such products.

The machine according to the present invention can also work as a machine for preparing a bituminous mixture, which can be used for closing holes in the road surface, even without using the laying device.

The machine 2 according to the present invention can be made to advance automatically when said second centering device 32, which in the preferred embodiment is a front arm connected to the steering system 33 and to the steering wheels of the truck, automatically guides the machine 2 along the track or trajectory defined by the microtrench "T". Said second centering device 32 can control the trajectory of the machine 2 by directly acting upon the steering system, in particular by turning also the steering wheel located in the back of the machine 2, which defines the operator's control station.

This advantage is achieved, therefore, when the second centering device 32 is placed inside the microtrench before the laying process.

Instead, when said second centering device 32 is in an idle configuration, e.g. before being moved to another place or being transported, the arm of the centering device 32 is raised and the operator can have full control over the machine 2 by operating the steering system 33, in particular the steering wheel.

Any technical feature illustrated for one specific embodiment must of course be understood as being also applicable to the other embodiments described herein, without however departing from the teachings of the present patent application.

REFERENCE NUMERALS

Machine 2
Truck 3
Drive system 31
Second centering device 32
Steering system 33
Preparing device 5
Container 50
Inlet opening 50*a*
Outlet opening 50*b*
Heating system 51
Mixing device 52
Mixing chamber 52*a*
Blade 522
Adjuster mechanism 523
First closing element 53
Second closing element 54
Laying device 6
Drain channel 61
Forming element 62
Compartment 622
Outlet opening 623
Levelling element 624
Vibrating system 626
Support structure 63
First centering device 64
Fumes control system 7
Exhaust chimney 72
Laying area A
Footprint area C
Axis of rotation k
Transversal width L
Microtrench T
Axis of symmetry X

The invention claimed is:

1. A machine for laying a bituminous carpet for closing microtrenches; said machine comprising:

a truck comprising a drive system for driving the machine, which defines a footprint area on a surface whereon the truck can move;

a preparing device for preparing bitumen for laying, said preparing device comprising:

at least one container for containing bitumen, said at least one container comprises an inlet opening into which bitumen is introduced;

an outlet opening through which bitumen prepared for laying can exit;

a heating system for raising temperature of the bitumen, at least in the preparing device;

a mixing device for mixing the bitumen while preparing the bitumen for laying;

a laying device for receiving the bitumen prepared for laying that exits through said outlet opening and laying the bitumen in carpet form, said laying device comprising:

a forming element for shaping the bitumen and laying the bitumen as a carpet over a laying area;

a drain channel interposed between the outlet opening and the forming element, for conducting the bitumen towards said forming element;

a centering device fixed to the machine and adapted to be inserted into the microtrench for moving the truck and/or the forming element in order to ensure that the forming element will be properly centered relative to the microtrench while laying the bitumen; the centering device comprising a mobile arm connected to a steering device acting upon steering wheels of the drive system.

2. The machine according to claim 1, wherein said preparing device is secured on said truck remaining substantially within an outline of the truck;

said laying device being secured to said truck and protruding from the outline of the truck.

3. The machine according to claim 1, wherein, through a support structure in said laying device, said forming element is arranged laterally relative to the truck, thus being able to lay the bitumen over a laying area defined by motion of the truck, said laying area is parallel to the footprint area of the truck, the footprint area of the truck being aligned to an axis of symmetry of the truck.

4. The machine according to claim 1, wherein said laying area has a transversal width in the range of 0.2 m to 0.02 m.

5. The machine according to claim 1, wherein said laying device and/or said mixing device comprise heating elements for contributing to at least keeping the bitumen hot.

6. The machine according to claim 1, wherein said mixing device and a mixing chamber, or a container, of the preparing device are shaped to allow mixing mixtures comprising bitumen and inert material as crushed stone.

7. The machine according to claim 1, wherein said forming element and said drain channel are shaped to allow laying mixtures comprising bitumen and inert material as crushed stone.

8. The machine according to claim 1, wherein said forming element comprises a compartment for collecting the bitumen coming from the drain channel, an outlet opening, through which the bitumen is laid, and a levelling element for levelling the bitumen just laid.

9. The machine according to claim 8, wherein said forming element comprises a pressing system for pressing the bitumen after laying and a vibrating system, applied to the compartment, for facilitating the laying of the bitumen.

10. The machine according to claim 1, wherein said forming element comprises the centering device.

11. The machine according to claim 1, wherein an end of the mobile arm of the centering device engages into the microtrench by a suitable rolling system, thus allowing the machine to exactly follow a layout of the excavated microtrench.

* * * * *